US006129132A

United States Patent [19]

Denoual et al.

[11] Patent Number: 6,129,132

[45] Date of Patent: Oct. 10, 2000

[54] SECTIONAL CLOSING DOORS

[75] Inventors: Daniel Denoual, Saint Genevieve des Bois; Maurice Perroux, Saint Etienne, both of France

[73] Assignee: FIT Carrosserie S.A., France

[21] Appl. No.: 09/324,185

[22] Filed: Jun. 2, 1999

[30] Foreign Application Priority Data

Jun. 12, 1998 [FR] France ..... 98 07671

[51] Int. Cl.[7] ..... E06B 3/12

[52] U.S. Cl. ..... 160/235; 160/232

[58] Field of Search ..... 160/235, 232, 160/229.1, 201, 40

[56] References Cited

U.S. PATENT DOCUMENTS

| | | | |
|---|---|---|---|
| 3,067,814 | 12/1962 | Anthony . | |
| 3,302,690 | 2/1967 | Hurd | 160/40 |
| 3,359,594 | 12/1967 | Pastoor | 160/235 X |
| 4,979,553 | 12/1990 | Lowry, III et al. . | |
| 5,909,762 | 6/1999 | Denoual et al. | 160/201 |
| 5,915,446 | 6/1999 | De Zen | 160/235 |

FOREIGN PATENT DOCUMENTS

| | | |
|---|---|---|
| 2045563 | 3/1971 | France . |
| 2756865 | 6/1998 | France . |
| 2072248 | 9/1981 | United Kingdom . |

*Primary Examiner*—David M. Purol
*Attorney, Agent, or Firm*—Wall Marjama Bilinski & Burr

[57] ABSTRACT

A sectional closing door having a plurality of interconnected panels, where each panel of the sectional door, except the upper and lower panels, includes matching profiles which interlock and are guided on matching profiles of adjacent panels to form a swivel joint and that the guiding of the profiles relative to each other is obtained with an angulation such that, when one panel is positioned at 90° relative to the adjacent panel, joining is insured with a component acting as a rider. The rider is designed with a U-shape that ensures it is connected to and integrated in one of the profiles of the end parts such that when one panel is swivelled to the maximum extent relative to another adjacent panel, the rider functions to insure a permanent joint and prevents the panels from becoming dislocated.

9 Claims, 3 Drawing Sheets

SECTIONAL CLOSING DOORS

BACKGROUND OF THE INVENTION

The invention relates to the technical sector of so-called sectional doors, i.e. doors that include several panels which are joined to each other and capable of sliding along guide profiles to ensure opening or closing of various locations which may be mobile or not, such as goods vehicles or garages or other storage premises.

The concept of panel-type sectional doors is well known in many closing applications and is described in particular in document U.S. Pat. No. 4,979,553. These doors are designed with a plurality of panels made of wood, metal, plastic or other material that are connected to each other thanks to special interlocking shapes which allow them to move along guide rails having several profiles allowing transition from a vertical plane to a horizontal plane and vice versa in order to obtain opening or closing allowing access to the desired location.

According to Patent GB 2072248, the guide rails are vertically fixed on uprights inside the platform of the vehicle chassis. These rails comprise a vertical part equivalent to the height of the opening and a radius of curvature with an extension as part of the horizontal rail. The various panels of the door are made of wood, for example, and have matching rebated profiles making it possible to fit a seal between the successive panel sections. In addition, there is provision at the ends of the upper panel, the lower panel and certain intermediate panels to position guide rollers capable of sliding in the running path formed on the rails. The rollers comprise a pin that is externally fixed to the section of the panels.

Such doors of this design have many drawbacks. Firstly, the guide rollers are subjected to considerable stresses and they have to be replaced regularly. Given the way the assembly is obtained, such replacement is relatively impracticable. In addition, the panels are heavy and require powerful drive motors in order to move the door when opening or closing it. Also, it should be noted that any damage to one panel is extremely troublesome because this makes it necessary to disassemble the entire door rather than simply the actual damaged panel.

SUMMARY OF THE INVENTION

In order to overcome these drawbacks, the Applicant has developed a new concept which is the subject of French Patent application FR 9615407.

According to the latter, the sectional closing door is of the type comprising a plurality of panels each designed with one or two shaped end forms permitting, after the coupling of two consecutive panels, the formation of a non-closed swivel joint between each of the panels, said panels being associated with means of enabling them to be moved from a vertical position to a horizontal position in order to allow door opening or closing and it is characterised in that said forms, arranged over all or part of the length of the panels, are internally shaped in order to allow, over all or part of their length, the positioning and housing of connecting pins associated with the means of driving and moving all of the said panels on the one hand and in that said forms are devised in order to allow the accommodation and interlocking of a matching shaped part constituting a rider made of one or more parts over the length of the various panels and forming a cover providing the closed finish of the swivel joint, on the other hand.

FIGS. 1A, 1B and 1C show, diagrammatically, the principle of the joint between the panels and their assembly illustrated according to the prior art defined in Patent Application FR 96.15407.

According to this, each panel (2), except the upper end panel and the lower end panel, is made with two special, matching end forms (2*a*), (2*b*) permitting the formation of a non-closed swivel joint between each panel. These forms (2*a*)–(2*b*) are produced over all or part of the length of the panels. A first form (2*a*) is made with a non-closed partially spherical part leaving an opening (2*a*-1). One of the ends (2*a*-2) connects to the outside plane (2*a*-3) of the panel, the other end (2*a*-4) protrudes from the side edge (2*a*-5). Said spherical part is made in order to constitute a housing on the outside and the inside.

The other end (2*b*) of panel (2) is designed with a curved inside profile (2*b*-1) made with a radius corresponding to the spherical part of the first panel end (2*a*) to provide a support and deflection plane. This curved profile (2*b*-1) extends on the outside as a non-closed sphere-shaped protruding part (2*b*-2) leaving an opening (2*b*-3) as a slot (2*b*-4) forming a receptacle for said first end (2*a*-2) of the panel. This sphere shape is situated substantially in the same plane as the previous one so that two consecutive panels are linked by inserting the first spherical end (2*a*-4) into above-mentioned slot (2*b*-4) of the second panel end (2*b*). The openings (2*a*-1) and (2*b*-2) on each of said spherical parts are identical and face each other when consecutive panels are perfectly axially aligned. The inside diameter of said second sphere is advantageously selected to allow positioning, centring and retention of pin (7*a*) of guide rollers (7) of the above-mentioned type. The inside bottom (2*b*-5) of said second sphere has a protruding curved shape capable of providing a seat for the pin of the above-mentioned rollers.

In order to ensure internal protection of the above-mentioned device, a matching part (8) is separately mounted forming a cover and, secondarily, constituting the roller support. This part is made in the form of a profiled rider having substantially U-shaped curved forms so that it can be fitted inside the above-mentioned spherical parts formed on the panels. This part forming a rider has wings (8*a*) forming lips capable of being joined by reduced thickness (8*b*) to the bottom surface (8*c*) of the rider. The rider is therefore elastic to a certain extent. Its outer surface (8*d*) also has a spherical profile to interlock and accurately close the matching parts of the device. The roller pin is securely held between the lips of the rider and the bottom of the spherical part of the panel.

Such an arrangement, although it operates satisfactorily, nevertheless has certain inadequacies in terms of risks of joint dislocation and inadvertent removal of the rider when moving or orienting the panels when the sectional door is closed or opened.

During additional research, the Applicant attempted to further enhance the reliability of the assembly and joining together of the panels, thus preventing any risk of the joint becoming dislocated.

This research resulted in an improved design of the forms of the panel ends of the sectional door as well as a new design for the part acting as a rider.

According to a first aspect of the invention, each panel of the sectional door, except the upper and lower panels, is designed with matching profiles which interlock and are guided on matching profiles of adjacent panels in the same way as a swivel joint and in that said guiding of said profiles relative to each other is obtained with an angulation such that, when a panel is positioned at 90° relative to the adjacent panel, joining is effective and in that the part acting as a rider is designed with a shape that ensures it is connected to and integrated in one of the profiles of the end parts when one panel is swivelled to the maximum extent relative to another adjacent panel.

According to another aspect, the forms of the shaped end parts of the panels are of the type capable of accommodating at least one part acting as a rider and cover which is U-shaped and has wings forming lips capable of elastic deformation with a bottom connecting surface and an external spherical-shaped surface that interlocks with matching spherical shapes forming the joint, the part acting as a rider being distinctive in that it is designed with a thin curved connecting profile, between its wings, and a long curved tab in its base starting in the connection area between one of the wings and the bottom surface and the end protrudes very substantially beyond the plane of the joint between the other wing and the bottom surface and in that said tab defines, together with the bottom surface, a curved gap or cavity.

These characteristics and others will become apparent from the rest of the description.

BRIEF DESCRIPTION OF THE DRAWINGS

The object of the present invention is described, merely by way of example, in the accompanying drawings in which.

DESCRIPTION OF THE INVENTION

In order that the present invention may more readily be understood, the following description is given, merely by way of example, reference being made to the accompanying drawings.

The sectional door comprises several consecutively assembled and joined panels (3). Each panel (3), except the upper and lower end panels, is designed with matching shaped end forms that interlock and are guided on matching profiles of adjacent panels in the same way as a swivel joint, guiding being obtained with an angulation such that when one panel is positioned at 90° relative to the adjacent panel, joining is effective.

More particularly, each panel (3) comprises, at a first end, upper end area (3*a*) and, at a second end, lower end area (3*b*) which are capable of interlocking in the forms on the adjacent panel (3*b*–3*a*) whilst assuring, over a wide angular section, continuous linking and guiding.

According to the invention, the first end form (3*a*) is designed with a reference surface (3*a*1) forming a curved seat having one or more projecting areas (3*a*2) protruding towards the inside from where there is a curved, non-closed, fork area (3*a*3) defining, together with the seat shape, a space (3*a*4) which is also curved. The protruding connecting areas (3*a*2) are rigid.

Also, the second end area (3*b*) is designed with a reference surface (3*b*1) forming a seat having a curved configuration and having, at one end adjacent to the plane in which the panels swivel relative to each other, a connecting area (3*b*2) beyond which there is a curved shape (3*b*3) capable of co-operating with the first end form (3*a*). More particularly, this non-closed shape (3*b*3) is established over an angular sector of the order of 260° with an opening (3*b*4) of the order of 100°. Profile (3*b*3) defines, together with reference surface (3*b*1), a gap (3*b*5) forming a recess capable of accommodating the corresponding part (3*a*3*a*) of the fork part established at the other end of the panel as shown in FIG. (3A). In addition, profile (3*b*3) is designed with two protruding projections (3*b*6) constituting limit stop areas for the wings of closing rider (4). The internal cavity (3*b*7) produced by profile (3*b*3) makes it possible to accommodate and guide wings (4*a*) of rider (4). The latter is designed with, between its wings (4*a*), a thin curved connecting profile (4*b*) and a long curved tab (4*c*), the base of which (4*d*) starts in the connecting area between one of wings (4*a*) and the bottom surface (4*e*) and end (4*f*) protruding very substantially beyond the plane of the joint between the other wing (4*a*) and the bottom surface. Said tab (4*c*), together with bottom surface (4*e*) defines a curved gap or cavity.

This long curved tab (4*c*) is capable of fitting in and being guided in gap (3*a*4) on shaped end form (3*a*) of the panel.

Figure 1A:
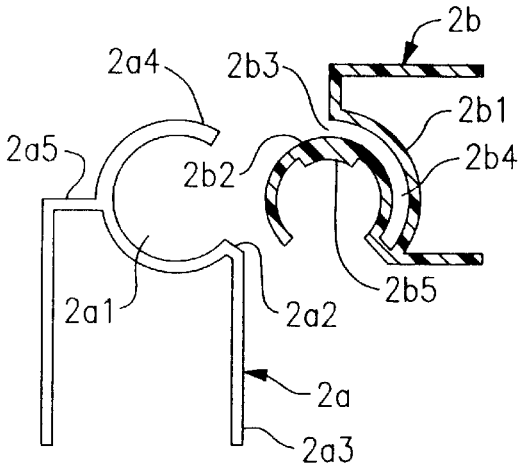
FIGS. 1A, 1B, 1C are schematic views showing the prior art defined in Patent Application FR 9615407.
Figure 1B:
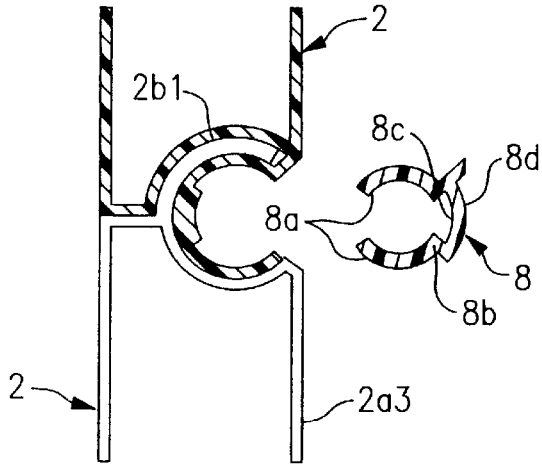
Figure 1C:
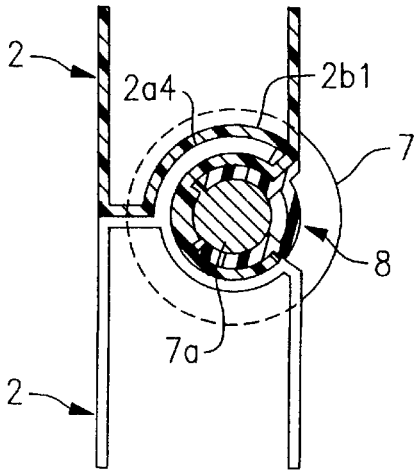
Figure 2:
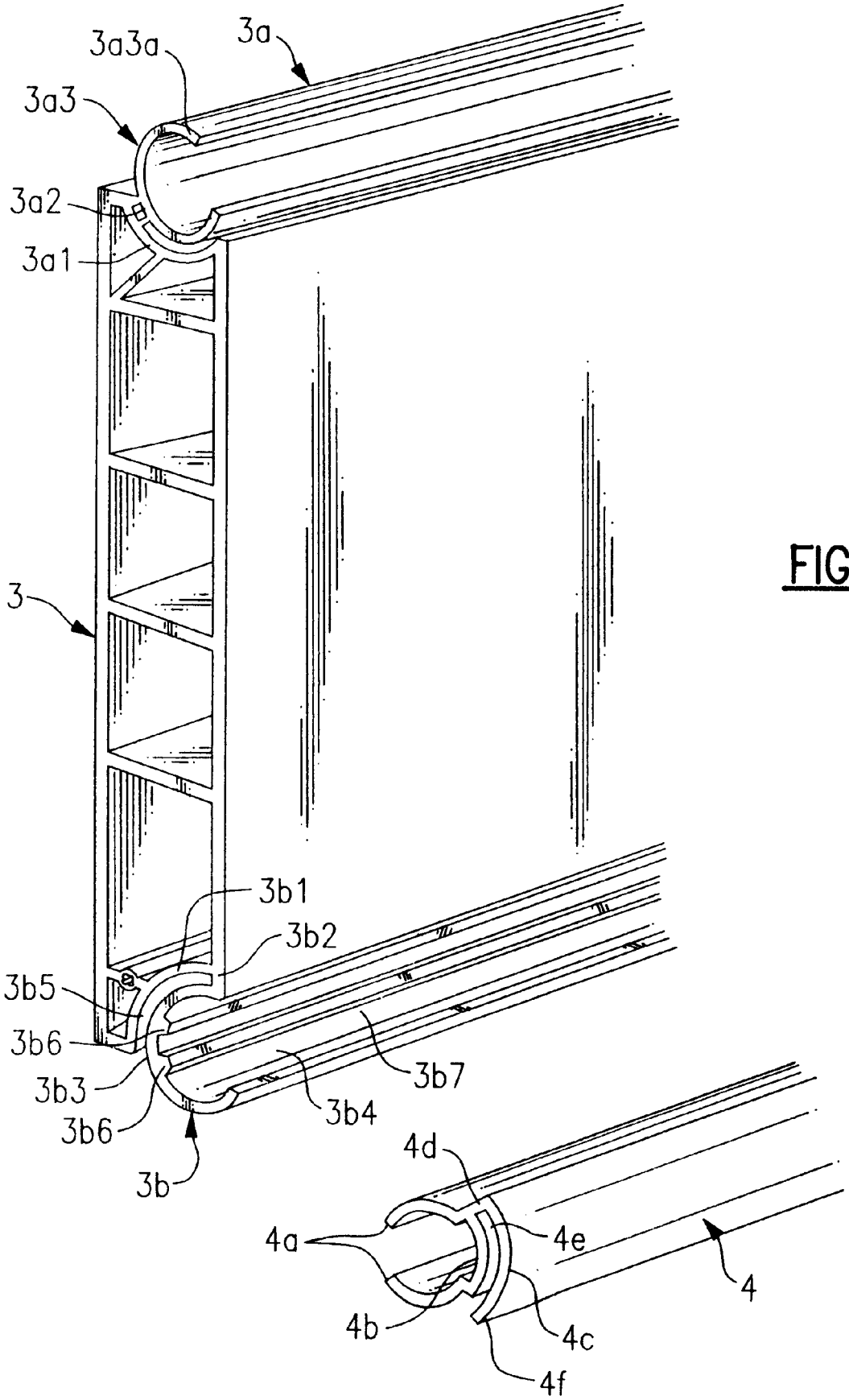
FIG. 2 is a view of a panel for sectional doors according to the invention showing an assembly rider.
Figure 3A:
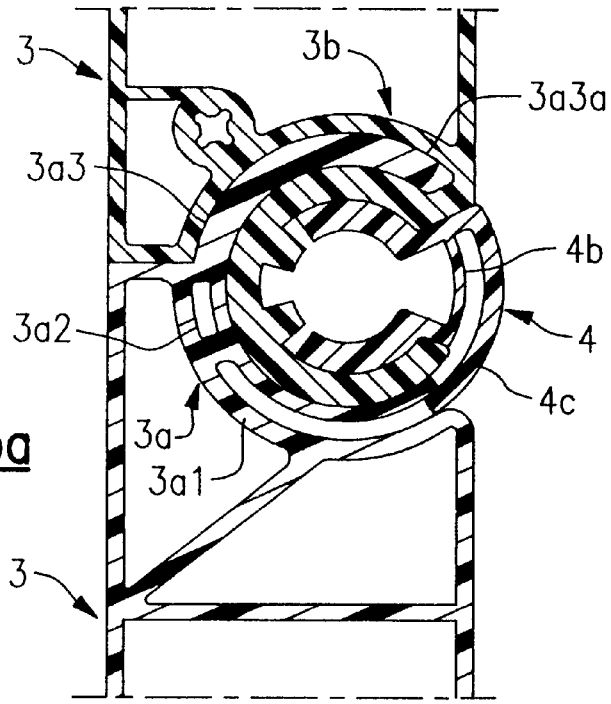
FIGS. 3A and 3B are partial views showing the assembly of two adjacent panels and their respective positioning in alignment or swivelling in the position where the door is opened or closed.
Figure 3B:
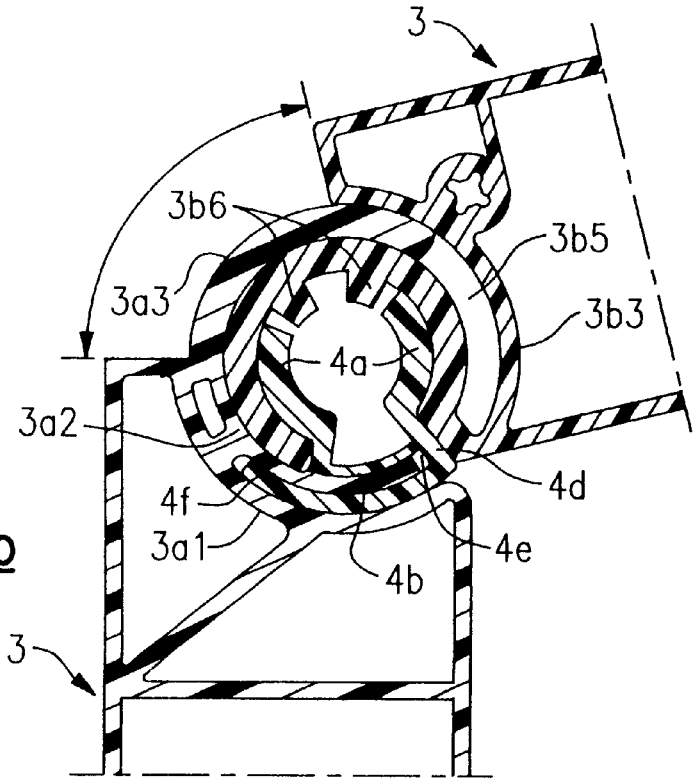

FIGS. 3A and 3B show that, in the position where two consecutive panels are aligned, tab (4*c*) of the rider is capable of shutting off the gap formed between the walls of two adjacent panels whereas part (3*a*3*a*) of the fork area (3*a*3) of the first end penetrates fully into accommodating space (3*b*5) of the second end area of the panel.

In the position where one panel is opened at an angle relative to the other as shown in FIG. 3B, it is apparent that curved tab (4*c*) of the tab has penetrated almost fully into the space (3*a*4) in the first end area whereas part (3*a*3*a*) of the fork shape has partially left an accommodating gap (3*b*5) although it is still partially engaged.

The configuration of the ends of said panels associated with the special-purpose shape of the rider ensures a permanent joint, under any circumstances, between these three components so that there is no risk of said panels becoming dislocated.

In addition, the interlocking of the respective different components under all handling circumstances provides an assurance of safety and reliability.

What is claimed is:

1. A sectional closing door comprising:

a plurality of panels consecutively coupled together, each said panel having at least integral one profiled end form over at least a portion of a length thereof, in which two end forms define between consecutively coupled panels an open-ended swivel joints;

at least one profiled matching part, said end forms when coupled being arranged to allow the reception and interlocking of said at least one profiled matching part constituting a rider made in one or more parts over the length of said coupled panels and forming a cover to close the open-ended swivel joint;

said plurality of panels including a top panel, a bottom panel and a predetermined number of intermediately coupled panels therebetween said intermediately coupled panels each having a first end form and a second end form, said first end form including a partially spherical section defined by a pair of ends, wherein interior and exterior surfaces of said partially spherical section define a housing, each of said end ends of said partially spherical section extending from a side edge of said panel, one of said ends of said panel while the other of said ends of said partially spherical section extends to an outside plane of the panel, said first end form further including a curved receiving slot for engagement with a curved connecting tab from a U-shaped, rider part;

in which said second end form includes a curved interior section having a radius corresponding to a radius of the exterior surface of the partially spherical section of the first end form of an adjacently coupled panel, constituting a support and reference plane, said interior section being prolonged on the outside by an open ended spherical shaped protruding part having an opening and an arcuate slot, said arcuate slot being bordered on one side by said curved interior portion and on an opposite side by an exterior surface of said protruding part, said arcuate slot forming a housing for the protruding end of said first end form, wherein the open ends of said partially spherical section and said protruding part face the outside plane of said panels when consecutive panels are in axial alignment after said first and second end forms are coupled together;

and in which said first and second end forms, when coupled, define an opening sized for receiving at least one profiled matching part or rider, said rider having a substantially U-shaped profile and including a pair of elastically deformable wings and an outside portion having a partially spherical profile, said outside portion interlocking in the opening defined in said coupled end forms to close the swivel joint, said rider further including an elongated curved tab which is designed to be received in mating engagement with said receiving slot in said first end form;

and whereby when a panel is positioned at 90° relative to an adjacent panel, joining is effective in that the part acting as a rider is connected to and integrated in one of the profiles of the end parts when one panel is swivelled to the maximum extent relative to another adjacent panel.

2. The sectional closing door of claim 1 in which said first end form includes a reference surface forming a curved seat having one or more projecting areas protruding towards the inside, from where there is a curved non-closed fork area defining, together with the seat shape, a space which is also curved.

3. A sectional closing door of claim 1 in which the second end form includes a reference surface forming a seat having a curved configuration and having at one end adjacent to the plane in which the panels swivel relative to each other, a connecting area beyond which there is a curved shape capable of co-operating with said first end form.

4. A sectional closing door of claim 3, characterized in that said curved shape is established over an angular sector of about 260° having an opening of about 100°.

5. A sectional closing door of claim 3 characterized in that said curved shape defines, together with said reference surface a gap forming a recess capable of accommodating the corresponding part of said fork part of said first end form.

6. A sectional closing door of claim 3 in which said second end form includes two internal protruding projections which function as limit stop areas for the wings of said rider.

7. A sectional closing door of claim 1 in which said curved interior section of said second end form accommodates the guide wings of said rider wherein said rider includes between said wings, a thin curved connecting profile and a long curved tab, the base of which starts in the connecting area between one of said wings and the bottom surface and said end, protruding very substantially beyond plane of the joint between said other wing and said bottom surface.

8. A sectional closing door of claim 7 in which said curved tab defines, together with said bottom surface, a curved gap or cavity, and where said curved tab is capable of fitting in and being guided in said gap on said first shaped end form.

9. A sectional closing door of claim 7 in that when in the position where consecutive panels are aligned, the tab of said rider is capable of shutting off the gap formed between the walls of two adjacent panels, and wherein the elongated part of the fork area of said first end form penetrates fully into said accommodating gap of said second end from of the panel, and in the position where one panel is opened at an angle relative to said other panel, said curved tab of said rider has penetrated almost fully into said space in said first end form, and whereby said elongated part of said fork shape has partially left an accommodating gap while still being partially engaged.

* * * * *